US008167663B1

(12) United States Patent
Lai et al.

(10) Patent No.: US 8,167,663 B1
(45) Date of Patent: May 1, 2012

(54) LATERALLY-PLUGGED POWER CONNECTOR

(75) Inventors: Chyi-Lang Lai, New Taipei (TW); Yen-Chih Chen, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 0 days.

(21) Appl. No.: 13/028,202

(22) Filed: Feb. 15, 2011

(51) Int. Cl.
*H01R 9/26* (2006.01)

(52) U.S. Cl. ..... 439/716; 439/660; 439/680

(58) Field of Classification Search ..... 439/660, 439/680, 715, 716
See application file for complete search history.

(56) References Cited

U.S. PATENT DOCUMENTS 5,540,595 A * 7/1996 Bernitz et al. ..... 439/76.1
5,735,700 A * 4/1998 Hohorst ..... 439/98
6,062,914 A * 5/2000 Fasano ..... 439/716
6,422,885 B2 * 7/2002 Kain et al. ..... 439/247
6,767,250 B2 * 7/2004 Casses et al. ..... 439/587
7,014,494 B1 * 3/2006 Lee et al. ..... 439/374
2004/0242042 A1 * 12/2004 Buck et al. ..... 439/160
2010/0062652 A1 * 3/2010 Liu ..... 439/660
2011/0115494 A1 * 5/2011 Taylor et al. ..... 324/537

* cited by examiner

*Primary Examiner* — James Harvey

(74) *Attorney, Agent, or Firm* — Chun-Ming Shih; HDLS IPR Services

(57) ABSTRACT

The power connector includes a plug assembly and a casing with a plug seat. The plug seat is formed with a room. There is a pair of rails in the room. Two electrode pins are separately mounted in the rails with exposed flexible contact portions. The plug assembly is provided with two plug pins and a pair of troughs corresponding to the two rails. Each of the plug pins has a conduction portion protruding from the troughs for making an electric connection with the flexible contact portions.

9 Claims, 7 Drawing Sheets

LATERALLY-PLUGGED POWER CONNECTOR

BACKGROUND OF THE INVENTION

1. Technical Field

The invention relates to connectors, particularly to power connectors.

2. Related Art

Usually, power connectors may be divided into two categories. The one category is provided with a fixed plug, and the other category is provided with a changeable plug. Those power connectors with changeable plugs may fit various kinds of sockets in different countries.

A power connector with a changeable plug is composed of a body and a plug which is detachably embedded into the body. However, the two pins of the plug are electrically connected to the electrodes in the body in a positively flexible manner. Thus interference and elastic fatigue tend to happen due to errors.

SUMMARY OF THE INVENTION

A primary object of the invention is to provide a power connector which can easily change plug assemblies and effectively reduce elastic fatigue.

Another object of the invention is to provide a power connector which can allow the plug assembly to be mounted in the casing in another direction. Thus the power connector may fit various situations.

To accomplish the above objects, the power connector of the invention includes a plug assembly and a casing with a plug seat. The plug seat is formed with a room. There is a pair of rails in the room. Two electrode pins are separately mounted in the rails with exposed flexible contact portions. The plug assembly is provided with two plug pins and a first pair of troughs corresponding to the two rails. Each of the plug pins has a conduction portion protruding from the troughs for making an electric connection with the flexible contact portions.

A second pair of troughs may be formed in the plug assembly, which is perpendicular to or obliquely crosses the first pair of troughs. And the conduction portion includes a first conduction portion and a second conduction portion extending therefrom. Thus the plug assembly may be mounted in the casing in another direction and the flexible contact portion can make electric connection with the first section or the second section of the conduction portion.

DETAILED DESCRIPTION OF THE INVENTION

Figure 1:
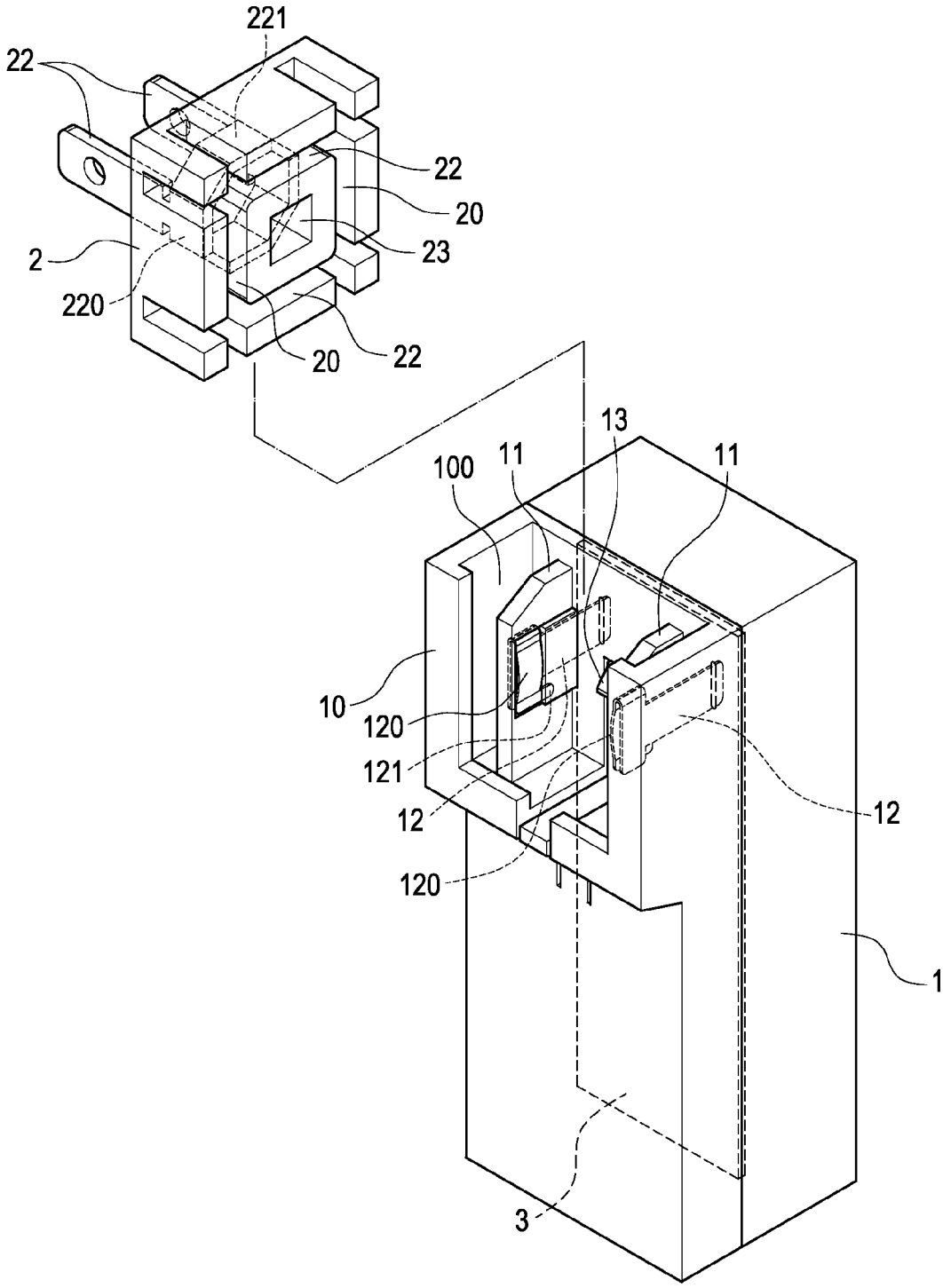
FIG. 1 is an exploded view of the invention.
Figure 2:
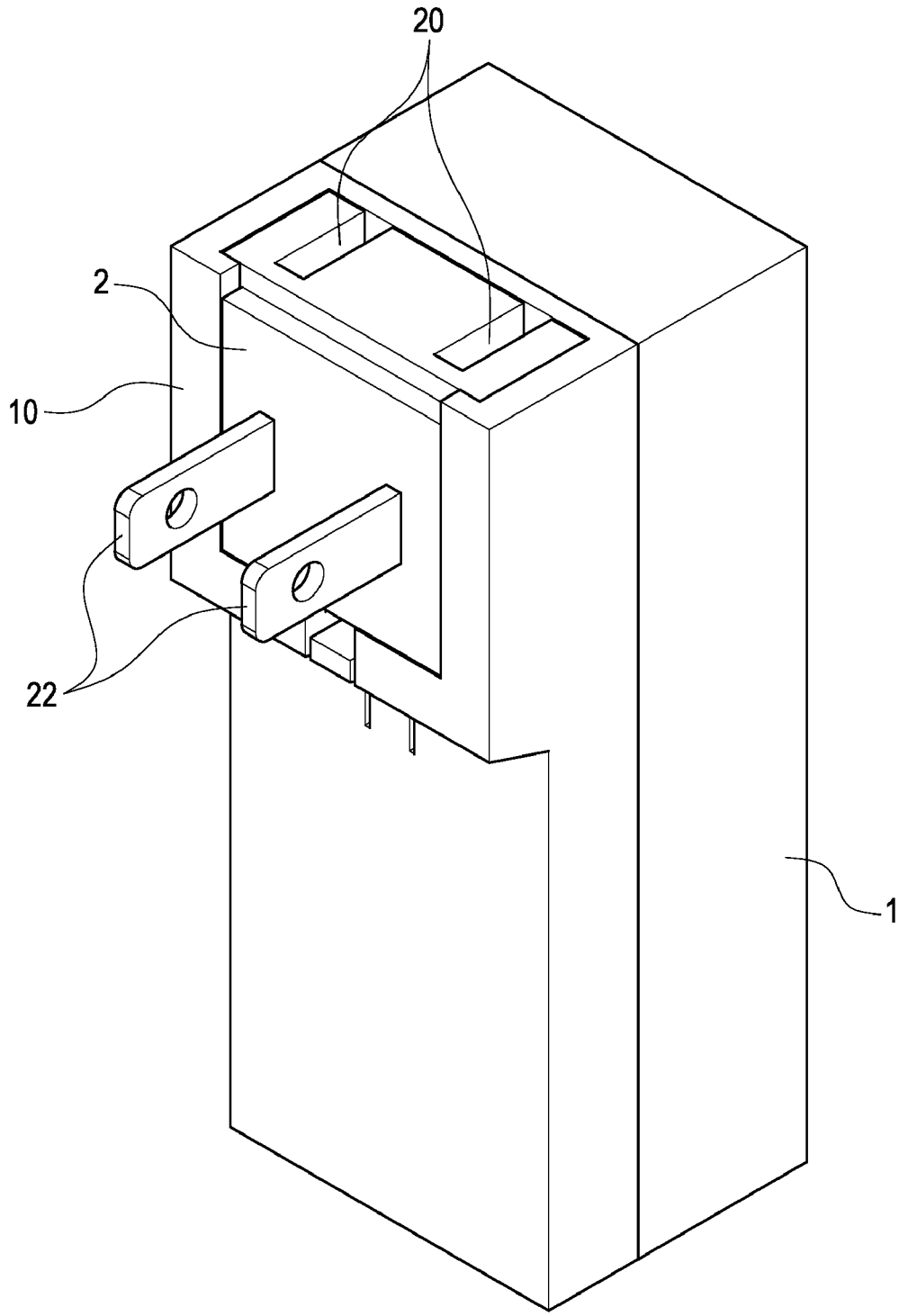
FIG. 2 is an assembled view of the invention.
Figure 3:
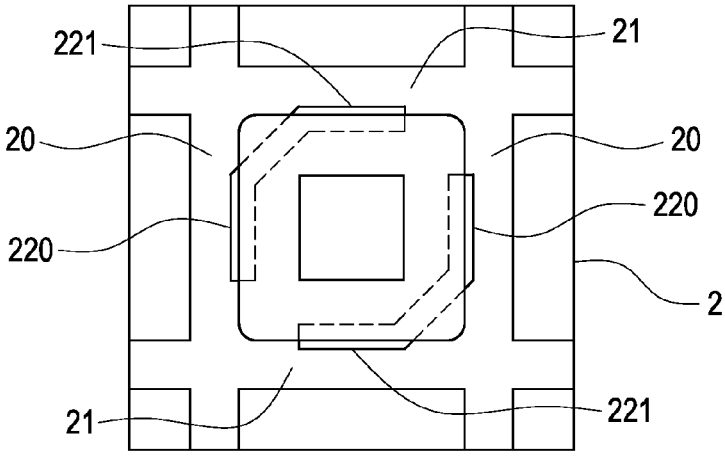
FIG. 3 is a plan view of the plug assembly.

Please refer to FIGS. 1 and 2. The power connector of the invention includes a casing 1 and a plug assembly 2.

Figure 4:
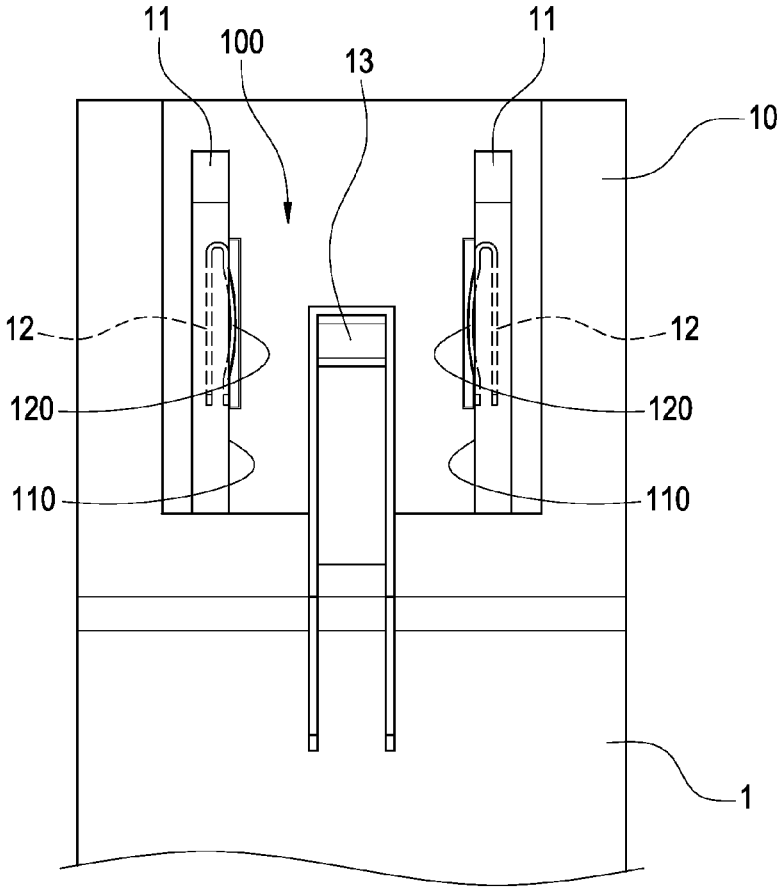
FIG. 4 is a plan view of the plug seat.

The casing 1 is provided with a plug seat 10. There is a room 100, which may receive the plug assembly 2, formed in the plug seat 10. The room 100 is provided with a pair of rails 11. The two rails 11 are separately mounted by two electrode pins 12. The electrode pins 12 are perpendicularly mounted on a circuit board 3 of the casing 1. Each of the electrode pins 12 has a flexible contact portion 120 (as shown in FIG. 4) which protrudes from the rails 11. In this embodiment, the flexible contact portions 120 are separately located on the opposite internal sides of the two rails 11. An end of each the flexible contact portion 120 is further formed with a protrusion 121 cloaked by the rails 11 for preventing the flexible contact portions 120 from unduly being deformed. The plug seat 10 may be further provided with a flexible fastener 13 for latching the plug assembly 2.

The plug assembly 2 may be configured into various types. A back side of the plug assembly 2 is formed with a first pair of troughs 20 corresponding to the rails 11. In this embodiment, a second pair of troughs 21 perpendicular to the first pair troughs 20 are arranged. A front side of the plug assembly 2 is provided with two plug pins 22. Please further refer to FIG. 4. Each of the plug pins 22 has a first conduction portion 220 protruding from the troughs 20, 21 and a second conduction portion 221 extending from the first conduction portion 220. The second conduction portion 220 protrudes from the second pair of troughs 21. Besides, the plug assembly 2 is provided with a recess 23 corresponding to the fastener 13.

Figure 5:
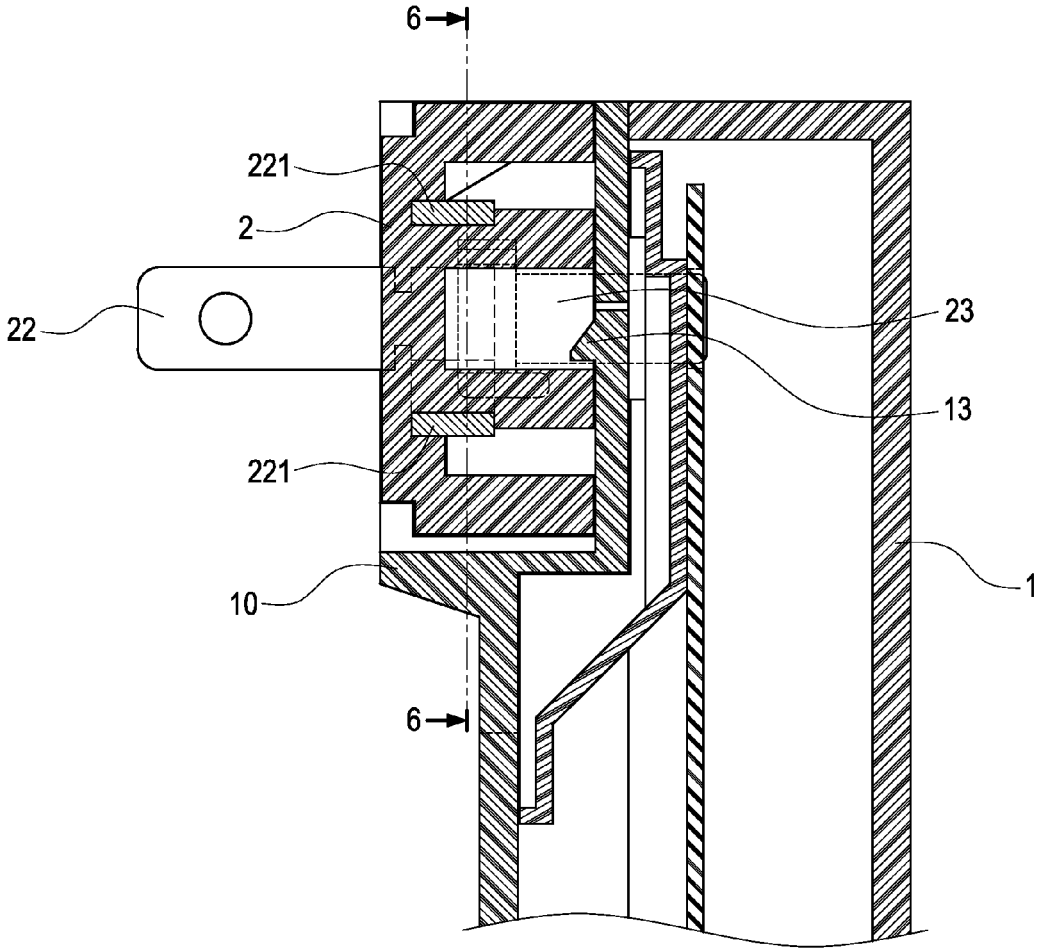
FIG. 5 is a cross-sectional view of the invention.
Figure 6:
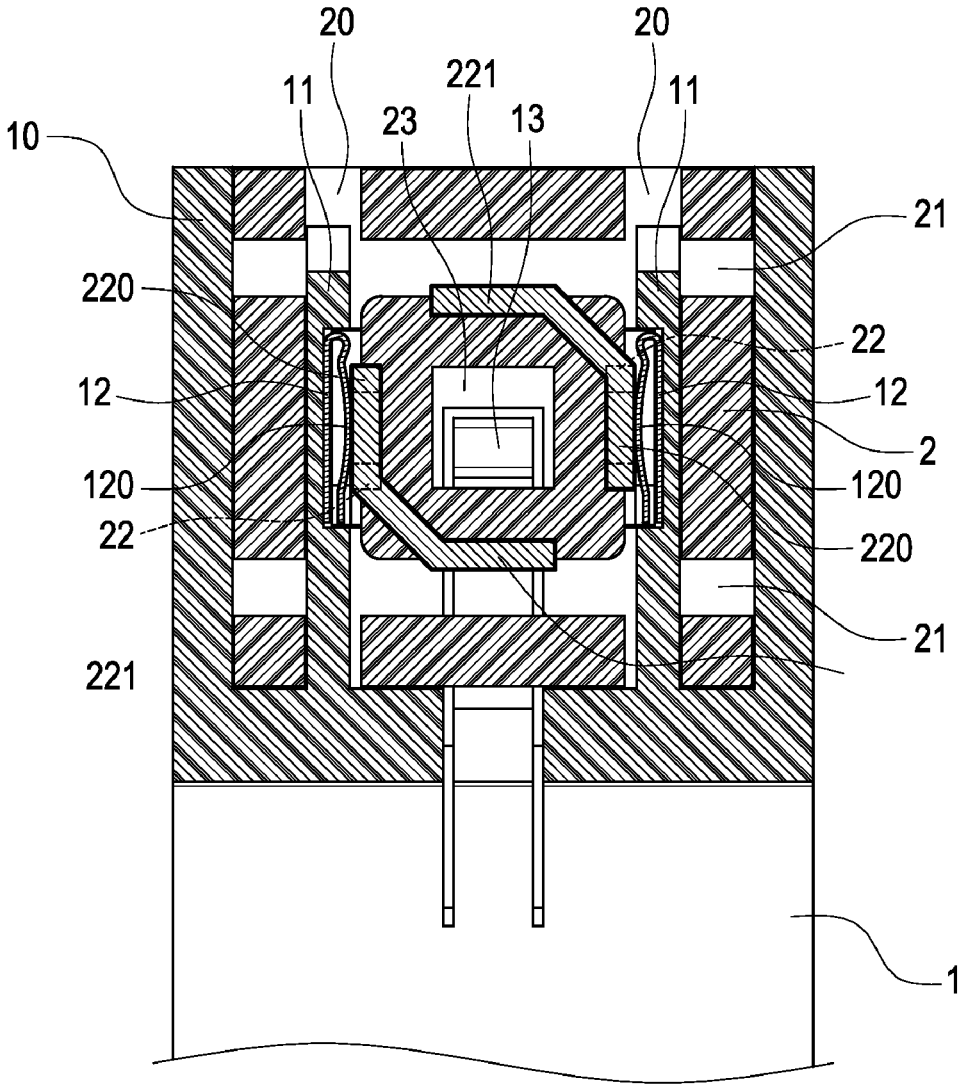
FIG. 6 is a cross-sectional view along line 6-6 in FIG. 5.
Figure 7:
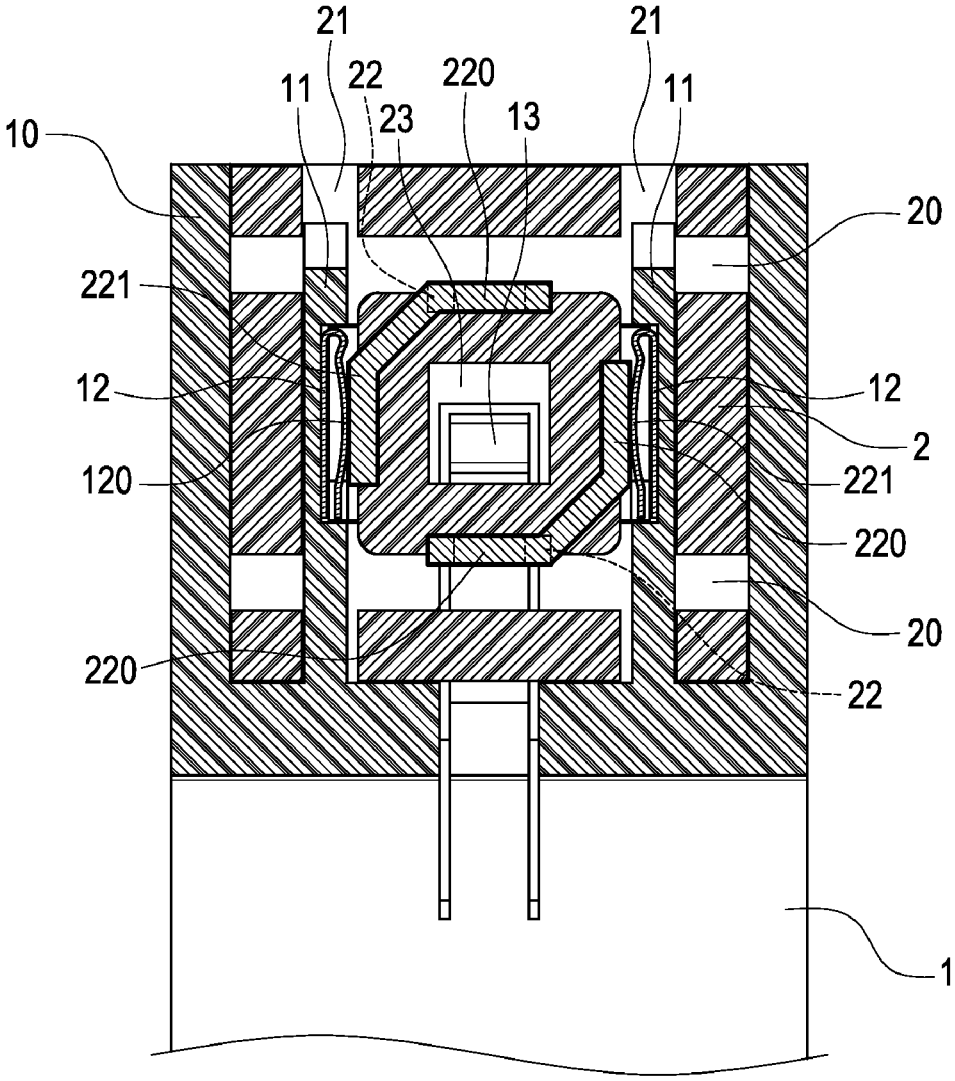
FIG. 7 is a cross-sectional view showing the plug assembly in another direction.

Please refer to FIGS. 5 and 6. The plug assembly 2 may be fixed in the casing 1 by embedding the rails into the first pair of troughs and inserting the fastener 13 into the recess 23. As can be seen in FIG. 6, the plug pins 22 separately make electric connection with the flexible contact portions 120. As shown in FIG. 7, when a user would like to change the direction of the plug pins 22, he or she may rotate the plug assembly 2 90 degrees to electric connect the flexible contact portion 120 with the second conduction portion 221.

Figure 8:
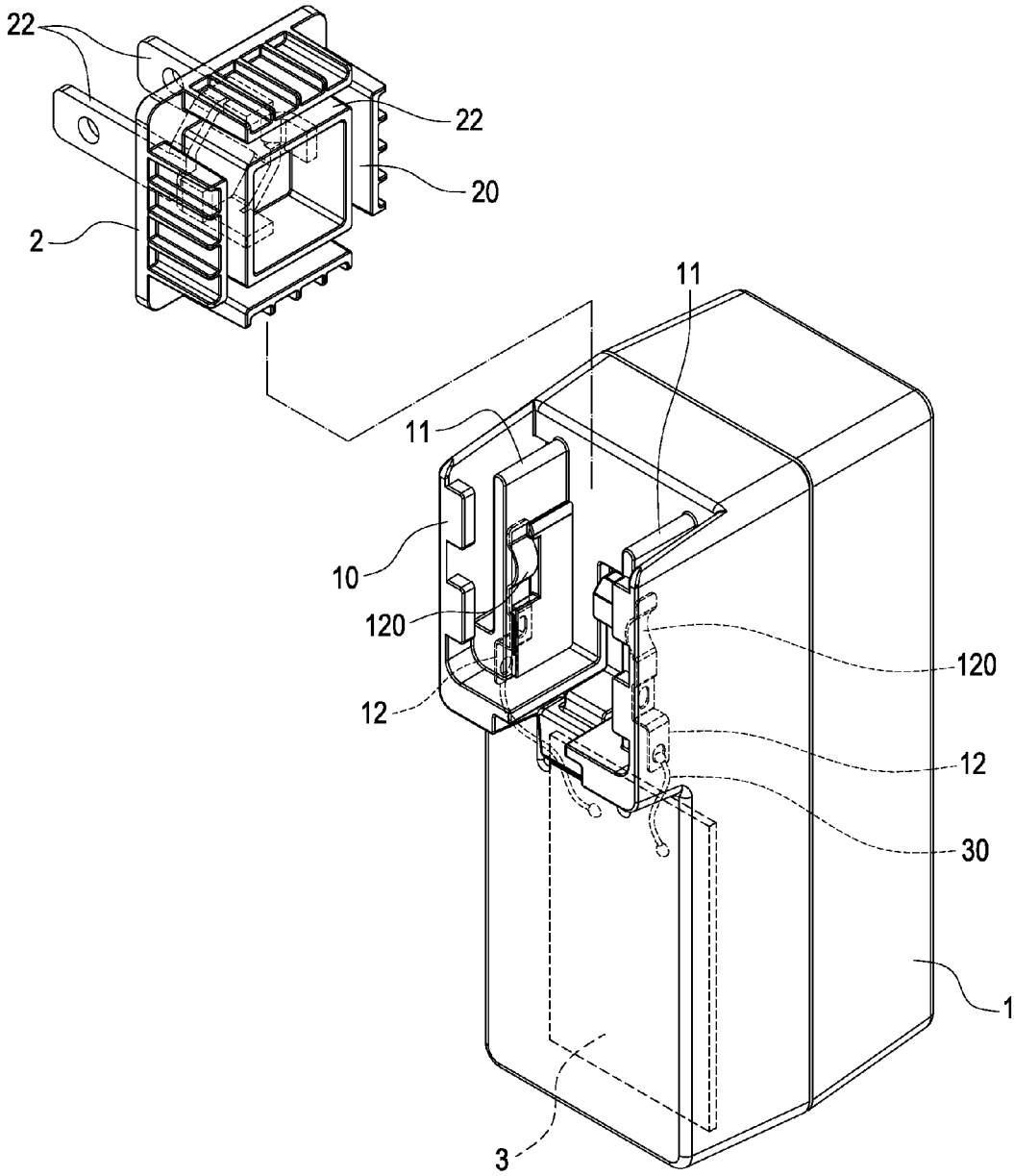
FIG. 8 is an exploded view of another embodiment of the invention.

As shown in FIG. 8, alternatively, the plug pins 12 may be connected to the circuit board 3 by wires 30. Thus the electrode pins 12 can be parallel to the circuit board 3. This can reduce the thickness of the casing 1.

While the forgoing is directed to various embodiments of the present invention, other and further embodiments of the invention may be devised without departing from the basic scope thereof. As such, the appropriate scope of the invention is to be determined according to the claims.

What is claimed is:

1. A power connector comprising:

a casing having a plug seat, the plug seat being formed with a room, the room being formed with a pair of rails, and the rails being separately mounted by two electrode pins with exposed flexible contact portions; and a plug assembly having two plug pins and a pair of troughs corresponding to the two rails, each of the plug pins has a conduction portion protruding from a bottom surface of one of the troughs and protruding into the troughs;

thereby electric connection is made between the conduction portions and the flexible contact portions by sliding the plug assembly into the room with embedding the rails into the troughs.

2. The power connector of claim 1, wherein the plug seat is provided with a flexible fastener, and the plug assembly is provided with a recess corresponding to the fastener.

3. The power connector of claim 1, wherein the pair of troughs includes a first pair of troughs and a second pair of troughs, the two pairs of troughs meet at a specific angle, the conduction portion includes a first conduction portion and a second conduction portion extending from the first conduction portion, and the second conduction portion protrudes from the second pair of troughs.

4. The power connector of claim 3, wherein the specific angle is 90 degrees.

5. The power connector of claim 1, wherein the flexible contact portions are separately located on the opposite internal sides of the two rails.

6. The power connector of claim 1, wherein an end of each the flexible contact portion is further formed with a protrusion cloaked by the rails.

7. The power connector of claim 1, further comprising a circuit board disposed in the casing, and the plug pins being perpendicularly mounted on the circuit board.

8. The power connector of claim 1, further comprising a circuit board disposed in the casing, and the plug pins being connected to the circuit board by wires.

9. The power connector of claim 8, wherein the plug pins are parallel to the circuit board.

* * * * *